United States Patent [19]

English

[11] 4,193,261

[45] Mar. 18, 1980

[54] METHOD OF OXIDATION OF FUELS WITH TETRAFLUORAMMONIUM BIFLUORIDE

[75] Inventor: William D. English, Orange, Calif.

[73] Assignee: TRW, Inc., Redondo Beach, Calif.

[21] Appl. No.: 879,636

[22] Filed: Feb. 21, 1978

[51] Int. Cl.[2] ..... C06D 5/08

[52] U.S. Cl. ..... 60/218; 60/214; 149/1; 331/94.5 G

[58] Field of Search ..... 60/214, 218; 149/1; 331/94.5 G

[56] References Cited

U.S. PATENT DOCUMENTS

| | | | |
|---|---|---|---|
| 3,879,680 | 4/1975 | Naismith et al. | 60/214 X |
| 3,928,821 | 12/1975 | Gregg et al. | 331/94.5 G |

*Primary Examiner*—Leland A. Sebastian

*Attorney, Agent, or Firm*—Christie, Parker & Hale

[57] ABSTRACT

A liquid mixture of tetrafluorammonium bifluoride in anhydrous liquid hydrogen fluoride in the liquid and/or gaseous decomposed state serves as an oxidizer for fuels. Tetrafluorammonium bifluoride is present in the liquid in an amount up to about 50 mole percent.

6 Claims, 1 Drawing Figure

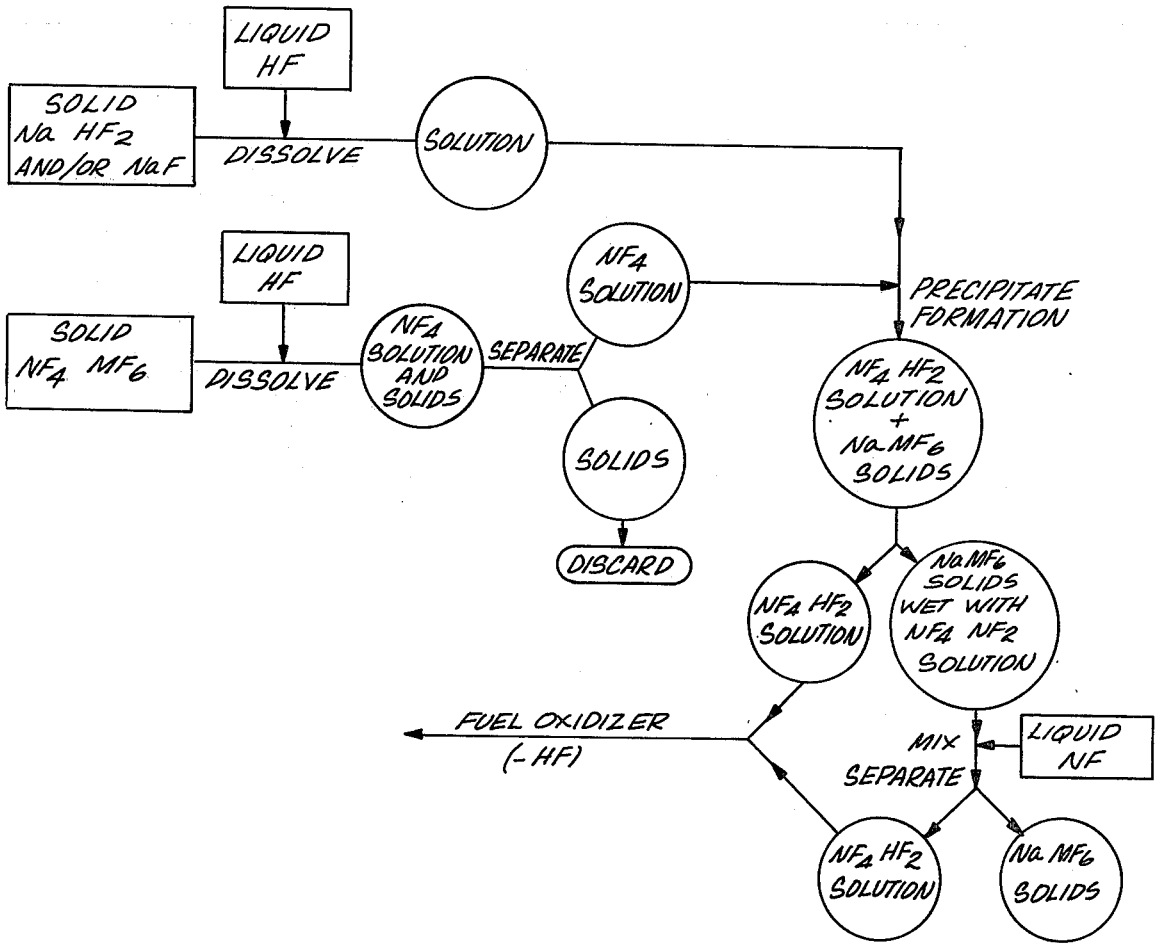
LIQUID HF
SOLID Na HF2 AND/OR NaF
DISSOLVE
SOLUTION
LIQUID HF
SOLID NF4 MF6
DISSOLVE
NF4 SOLUTION AND SOLIDS
SEPARATE
NF4 SOLUTION
SOLIDS
DISCARD
PRECIPITATE FORMATION
NF4 HF2 SOLUTION + Na MF6 SOLIDS
NF4 HF2 SOLUTION
Na MF6 SOLIDS WET WITH NF4 NF2 SOLUTION
FUEL OXIDIZER (-HF)
MIX SEPARATE
LIQUID NF
NF4 HF2 SOLUTION
Na MF6 SOLIDS

METHOD OF OXIDATION OF FUELS WITH TETRAFLUORAMMONIUM BIFLUORIDE

BACKGROUND OF THE INVENTION

Tetrafluorammonium tetrafluoroborate ($NF_4BF_4$) is used as a common ingredient in formulations for oxidizer source solid gas generators which find particular utility in combustion driven chemical lasers and other oxidation applications.

It has been demonstrated that tetrafluorammonium tetrafluoroborate may be prepared by metathesis of $NF_4SbF_6$ with CsF or AgF in anhydrous hydrogen fluoride to yield $CsSbF_6$ or $AgSbF_6$ as a precipitate and tetrafluorammonium bifluoride which is in turn reacted with boron fluoride to yield tetrafluorammonium tetrafluoroborate. The net reactions for cesium fluoride, for instance, may be written as $$NF_4SbF_6 + CsF \xrightarrow[\text{Solution}]{HF} CsSbF_6\downarrow + NF_4HF_2$$

Removal of the solid precipitate and treatment of the liquid phase which $BF_3$ forms the $BF_4$ salt by the reaction $$NH_4HF_2 + BF_3 \xrightarrow[\text{Solution}]{HF} NF_4BF_4 + HF$$

Excess hydrogen fluoride is removed by evaporation.

Subject to strict safety precautions, $NF_4AsF_6$ may also be reacted with RbF to yield $RbAsF_6$ as the precipitate as a predicate to forming $NF_4BF_4$ from $NF_4HF_2$.

The main deficiency in the procedure is the cost of the added metal fluoride. The present cost of cesium fluoride is about $15,000 per pound mole and the cost of silver fluoride $15,500 per pound mole.

Moreover, there is always a solid residue of the reactions which occur in the use of a heavy metal fluoride compound as an oxider. It would be desirable to provide an oxider source which does not leave such a residue.

SUMMARY OF THE INVENTION

According to the present invention, there is provided a process for the generation of energy for oxidation of fuels. The oxidizer for the process is provided as a solution of the compound tetrafluorammonium bifluoride ($NF_4HF_2$) in anhydrous liquid hydrogen fluoride.

The solution is hypergolic and as such can be used as a direct liquid oxidizer for fuels in propellant applications. For other applications, such as the oxidizer requirements for chemical laser, the solution upon evaporation of hydrogen fluoride by heat and/or evacuation decomposes smoothly and quietly to a gaseous mixture of $NF_3$, $F_2$ and HF.

The liquid oxider may contain up to about 50 mole percent tetrafluorammonium bifluoride depending upon the decomposition temperature desired. Decomposition temperature is about 50° C. for a equimolar mixture and higher for more dilute solutions. A preferred range of concentration of the tetrafluorammonium bifluoride is from about 20 to about 50 mole percent offering a stable temperature range from about 100° C. to about 50° C. with the stability temperature being enversly proportional to molar concentration. An equimolar concentration is preferred providing as the effective composition: $NF_5+2HF$.

IN THE CONCENTRATION RANGES DESCRIBED ALSO THE DRAWING

The attached Drawing schematically illustrates an economical route to the production of a mixture of tetra fluorammonium bifluoride in anhydrous liquid hydrogen fluoride.

DETAILED DESCRIPTION

The present invention provide for the use of a solution of tetrafluorammonium bifluoride in anhydrous liquid hydrogen fluoride as an oxidizer for fuels. The solutions depending on tetrafluorammonium bifluoride are stable at temperatures of 50° C. to 100° C. or more.

The molar ratio employed may vary widely up to a limit of about 50 mole percent tetrafluorammonium bifluoride, the balance being substantially anhydrous liquid hydrogen fluoride. The preferred range if from about 20 to about 50 mole percent tetrafluorammonium bifluoride, most preferably about 50 mole percent. In the high concentrations the compositions are stable at temperatures of about 50° C.

Being, in any event, stable at ambient temperature, they are storable at such temperatures, can be flowed, pumped, filtered and otherwise handled; provided the solutions are protected against contact with moisture and oxidizable substances until use. The solution is generally not corrosive to Monel and other metals.

Besides ease of handling, the solutions react or decompose in use to yield $NF_3$, $F_2$ and HF as oxidizers without leaving, except of impurities resulting from their formation, solids to cope with or scavange. The most preferred composition is equimolar having the effective composition: $NF_5+2HF$.

The solutions, if used in the liquid state, are hypergolic and can be combined with propellant fuel such as hydrogen, toluene, hydrazine, mixed hydrazines, aniline, pentaboranes, kerosene, solid rocket propellants and the like. Such fuels are generally characterized as having a high molar proportion of free and/or bound hydrogen. Mere combination of the mixture of tetrafluorammonium bifluoride in anhydrous hydrogen fluoride will result in ignition of fuels with attendant generation of energy.

The solution of tetrafluorammonium bifluoride in anhydrous liquid hydrogen fluoride may, in the alternative, be decomposed to a mixture of $NF_3$, $F_2$ and HF for use as the oxidizer. Decomposition may be by evaporation of hydrogen fluoride by evacuation and/or the application of heat.

The decomposition products may serve as a propellant fuel oxidizer and are particularly useful as an oxider for fuels used in chemical lasers. Of the fuels used in such lasers, there may be mentioned hydrazine deuterium, hexafluorobenzene, ammonia, nitrogen trioxide, toluene and the like. Chemical lasers are described in the publication "Chemical Lasers" by George C. Pimentel, *Scientific American,* April, 1966, incorporated herein by reference.

In either event, the amount provided to the fuel is sufficient to initiate and sustain by pergolic combustion to yield energy from the fuel.

The solution of tetrafluorammonium bifluoride in anahydrous liquid hydrogen fluoride may be formed in any desired manner. The most economical route is by methathesis of the compound $NF_4MF_6$ whrein M is a group V metalloid by reaction with a fluoride of sodium such as sodium fluroide, sodium bifluoride and mixtures thereof at a small fraction of the cost of reactants such as CsF and AgF, namely about $50.00 per pound mole.

With reference to the Drawing, the process comprises first forming a solution of a fluoride of sodium, namely, sodium fluoride, sodium bifluoride or mixtures thereof, in anhydrous liquid hydrogen fluoride in the absence of moisture and oxygen. Formation of the solution occurs in a vessel wherein the liquid hydrogen fluoride is maintained in a liquid state by virtue of its own pressure. Temperatures of solution are not narrowly critical and typically temperatures from −50° C. to 100° C. can be used. Temperatures from about 0° C. to ambient are preferred since little advantage is to be gained by forming the solutions at temperatures above ambient and maintaining lower temperatures also constitute an energy cost.

Separately, there is formed a solution of the compound $NF_4MF_6$ in anhydrous liquid hydrogen fluoride, again, in the anhydrous state. Each solution in this and other stages of the process is desirably maintained under atmosphere of hydrogen fluoride which by its own pressure maintains hydrogen fluoride in the liquid state.

Any solids which fail to dissolve in the anhydrous liquid hydrogen fluoride are separated and discarded. This leaves a solution containing the metal to be metathesized. The two solutions are then combined. Upon mixing, the metathesis reactions:

$$NF_4MF_6 + NaF \xrightarrow[\text{Solution}]{HF} NaMF_6 + NF_4HF_2, \text{ and/or}$$

$$NF_4MF_6 + NaHF_2 \xrightarrow[\text{Solution}]{HF} NaMF_6 + NF_4HF_2$$

almost instantaneously occur over the temperature range set forth above. The product of the metathesis reaction, $NaMF_6$, will, at ambient temperatures and below, be precipitated at least in part from the formed solution of $NF_4HF_2$ in hydrogen fluoride.

If higher temperatures are employed, the formed species may remain in solution or precipitate therefrom, depending upon the concentrations of the reactants employed.

To maximize purity of the tetrafluorammonium bifluoride ($NF_4HF_4$), the solution is cooled to a temperature of −20° to −50° C. to cause precipitation of the formed $NaMF_6$. At temperatures above −20° C., the formed $NaMF_6$ will remain in solution to the extent that the end product will be one of less than desired purity. The optimum temperature, based on viscosity and purity considerations, is about −40° C.

After formation of the solids, the solution of tetrafluorammonium bifluoride in hydrogen fluoride is separated from the solids which are still wet with the valuable tetrafluorammonium bifluoride. Although solids are discardable as a by-product of this juncture, they are advantageously processed for recovery of as much of the tetrafluorammonium bifluoride as possible. To this end, the solids wet with the tetrafluorammonium bifluoride in hydrogen fluoride may be broken and agitated to release as much of the bound liquor as possible and then liquid hydrogen fluoride added in one or more washes to remove tetrafluorammonium bifluoride from the solids. The wash solutions are added to the solution formed as a consequence of the metathesis reaction.

They may be used as such or concentrated by removal of hydrogen fluoride as the evacuation to form stable solutions. The solution can be used as such for direct contact with fuel. By heating for removal of additional hydrogen fluoride, the solutions will reach a temperature or a concentration where decomposition to $NF_3$, $F_2$ and HF will occur. This may be reserved to within the combustion chamber. In this instance, the solution may be injected as liquid to an ignited fuel and will therein decompose to provide additional oxidizer to sustain combustion.

The following examples illustrate the preparation of solutions of tetrafluorammonium bifluoride for use as oxidizers.

Example I—Preparation of $NF_4HF_2$

With cooling, there was dissolved 102.8 g of $NaHF_2$ in 807 g of anhydrous liquid hydrogen fluoride. This first solution was maintained at about 0° C. A second solution was formed with slight warming by addition of 485 g of a salt mix (90 mole % $NF_4SbF_6$) in 629 g of anhydrous fluoride. Twenty grams of residual dry solids were removed from the second solution. The second solution was added to the first solution with stirring over a 20 minute period while maintaining temperature at 0°±5° C. The mixed solutions were agitated for 5 minutes while cooling to −50°±5° C. After 3 minutes setting time during which a precipitate was formed, the mother liquor ($NF_4HF_2$ in anhydrous $HF_2$) was removed. The precipitate was agitated three separate times to break dendritic structure and release additional mother liquor which was separated after each agitation step from the solids and until the volume of mother liquor released was less than 10 ml. The solids in crystalline form were respectively mixed with 56.53 g, then 51.13 g of anhydrous hydrogen fluoride to remove entrained $NF_4HF_2$. In each instance, after agitation and resettling of solids, the liquor separated from the solids was combined with the previously removed mother liquors. The total quantity of liquid collected was 1667 g. The solids having a dry weight of 281 g contained 0.6% by weight $NF_3$. Ten milliliters (14.6 g) of the liquid obtained was also evaporated to dryness. 1.87 g of solid was obtained. The solids contained 10% by weight $NF_3$.

Example II—Preparation of $NF_4HF$

With cooling, there was dissolved 102.0 g of $NaHF_2$ in 834 g of anhydrous liquid hydrogen fluoride. This first solution was maintained at about 0° C. A second solution was formed with slight warming by addition of 491 g of a salt mix (90 mole % $NF_4SbF_6$, 10 mole % $SbF_5$) in 566 of anhydrous fluoride. Eight grams of residual dry solids were removed from the second solution. The second solution was added to the first solution with stirring. The mixed solutions were agitated with cooling to −50°±5° C. After a precipitate formation, the mother liquor ($NF_4HF_2$ in anhydrous $HF_2$) was removed. The precipitate was agitated three separate times to break dendritic structure and release additional mother liquor which was separated after each agitation step from the solids and until the volume of mother liquor released was less than 10 ml. The solids in crystalline form were in two washes, washed with a total of 74 grams of anhydrous hydrogen fluoride to remove entrained $NF_4HF_2$. In each instance, after agitation and resettling of solids, the liquor separated from the solids and combined with the previously removed mother liquors. The total quantity of liquid collected was 2061 g. The solids having a dry weight of 371 g contained 0.0 by weight $NF_3$.

What is claimed is:

1. A method for the generation of energy which comprises combining an oxidizable fuel with a solution of tetrafluorammonium bifluoride in anhydrous liquid hydrogen fluoride provided in an amount sufficient for hypergolic oxidization of said fuel, the tetrafluorammonium bifluoride content of the solution being up to about 50 mole percent, the balance of the solution being substantially anhydrous liquid hydrogen fluoride.

2. The method of claim 1 in which the tetrafluorammonium bifluoride content of the solution is from about 20 to about 50 mole percent.

3. The method of claim 1 in which the tetrafluorammonium bifluoride content of the solution is about 50 mole percent.

4. A method of generation of energy by which comprises (a) decomposing a solution containing up to about 50 mole percent of tetrafluorammonium bifluoride, the balance of the solution being substantially anhydrous liquid hydrogen fluoride to generate a gaseous mixture of $NF_3$, $F_2$ and HF; and (b) combining the gaseous mixture with a fuel oxidizable thereby in an amount sufficient to oxidize the fuel and generate by oxidation energy.

5. The method of claim 4 in which the gaseous mixture of $NF_2$, $F_2$ and HF is generated by decomposing a solution containing from a 20 to about 50 mole percent tetrafluorammonium bifluoride, the balance of the solution being substantially anhydrous liquid hydrogen fluoride.

6. The method of claim 4 in which the gaseous mixture of $NF_2$, $F_2$ and HF is generated by decomposing a solution containing about 50 mole percent tetrafluorammonium bifluoride, the balance being substantially anhydrous liquid hydrogen fluoride.

* * * * *